United States Patent [19]

Bühler

[11] Patent Number: 4,593,740

[45] Date of Patent: Jun. 10, 1986

[54] METHOD AND APPARATUS FOR FREEING A PATTERN OR SHAPING ELEMENT FROM FOUNDRY MATERIAL

[76] Inventor: Eugen Bühler, Schleifweg 3, 8877 Burtenbach, Fed. Rep. of Germany

[21] Appl. No.: 528,297

[22] Filed: Aug. 31, 1983

[30] Foreign Application Priority Data

Feb. 8, 1983 [DE] Fed. Rep. of Germany ..... 3304148

[51] Int. Cl.[4] ..... B22C 9/00; B22C 17/00

[52] U.S. Cl. ..... 164/44; 164/180

[58] Field of Search ..... 164/44, 169, 180–191; 49/477

[56] References Cited

U.S. PATENT DOCUMENTS 4,114,901 9/1978 Pot ..... 49/477

4,182,395 1/1980 Buhler ..... 164/160.1

FOREIGN PATENT DOCUMENTS 54-46128 4/1979 Japan ..... 164/187

1151237 5/1969 United Kingdom .

*Primary Examiner*—Gene P. Crosby

*Assistant Examiner*—Richard K. Seidel

*Attorney, Agent, or Firm*—Jones, Tullar & Cooper

[57] ABSTRACT

A foundry mold making machine is so designed that at the start of the process of moving the pattern assembly clear of the mold, compressed air is supplied through the pattern assembly until a gap or narrow space has been formed between the mold and the pattern. In this respect an air-tight connection is maintained between the pattern plate support and the flask until the compressed air supplied to the gap has been relaxed. In this way it is possible to make certain that there is no damage to the edges of the mold by suddenly letting off air.

17 Claims, 3 Drawing Figures

METHOD AND APPARATUS FOR FREEING A PATTERN OR SHAPING ELEMENT FROM FOUNDRY MATERIAL

BACKGROUND OF THE INVENTION

The present invention relates to foundry operations and more specially to methods and to mold or pattern assemblies that are designed so that such pattern assemblies may be taken from a mold with the use of compressed air as a driving force. The preferred, but not the only, field of use of the present invention is the production of foundry molds made of foundry sand containing clay binder, or like sands, in mold making machines with a pneumatic and/or mechanical compacting system, in the case of which the foundry molds may have a pattern sand layer of a mold material with a heat-curing binder.

DISCUSSION OF THE PRIOR ART

British Pat. No. 1,151,237 relates to methods and apparatus for lifting cured mold shell halves and cores clear of the heated mold or pattern means by blowing compressed air through holes with sand-tight filters in the pattern means against the mold shell halves or cores.

However although this method may be simple and cheap, it is not readily used for the production of foundry molds of clay-bonded wet foundry sands or the like, because as a rule such mold materials have a lower strength than shell mold material with a synthetic resin binder.

In fact it has been seen from experience that on lowering patterns with deep mold contours out of the mold using compressed air there is likely to be a loss of the driving air shortly after the start of the lowering operation, such air being let off at a high speed through the gap between the surface of the mold and the pattern means so that mold sand is broken off at the ends of the mold space and the castings produced with a large amount of flash at the mold parting plane. The amount of fettling work then needed so increases prices that production is no longer economic.

There has furthermore been a suggestion to have mechanical or pneumatic springs in the pattern under the deep mold contours for making the lowering operation simpler. The pattern means or assembly then however becomes higher in price and furthermore there is then a danger of the mold wall being bent out of shape by the springs so that such a system is of little value for day-in day-out operation in heated pattern assemblies for shell molds.

SUMMARY OF THE INVENTION

One purpose of the invention is designing a method together with mold and pattern means with which even molds made of wet foundry sands containing a clay binder may be lifted clear of the pattern means undamaged or the pattern means may be lowered downwards clear of the mold.

For effecting this purpose and other purposes, an air-tight connection is produced between the edge of the pattern plate, or the pattern plate support, and the flask support placed round it and the flask and the connection is kept in existence till the pattern means has been completely separated from the surface of the mold material and the supply of compressed air to the gap-like space formed between the pattern means and the mold is turned off before the air-tight connection between the edge of the flask and the edge of the pattern plate or the support of the pattern plate of the flask is broken.

For making the method safer the compressed air may be let off from the gap-like space through the pattern plate or the hollow pattern plate support before the air-tight connection between the flask edge and the mold or pattern means is broken.

For making use of the method a mold and pattern assembly is used that makes it possible to keep up a connection that is air-tight enough with the flask till, on lifting or lowering, a gap-like air-filled space is formed between the pattern and mold surface.

Compressed air-tight connections may, in a simple form thereof, be between metal surfaces on the edge of the pattern plate and the wall of the flask. However they may furthermore take the form of an elastomeric seal, with or without means for inflating it, between the flask edge and the support of the pattern plate and the flask. In this case such a pattern plate support may be best separated by upright parting walls into at least two air spaces able to be filled with air at different pressures. In this respect a useful effect is to be had if there is a middle air space under (or in the case of two-sided pattern plate supports, over as well) the patterns, the said space being joined up pneumatically with air openings. The middle air space had a second air space placed round it, that is joined up pneumatically with air outlet openings placed outside the edge of the pattern plate. By way of a valve circuit it is possible for the two air spaces to be switched in parallel, to be filled with air at different pressures separately from each other or for the air to be pumped off from them. For example, for filling the flask with mold sand the two spaces are suddenly put under vacuum. For lowering or lifting the pattern on the other had the outer air space may be connected with the normal outside pressure and the middle air space may be filled with air at pressure higher than that of the atmosphere. The inner air space is in this respect best joined up by way of an air duct with a built-in differential pressure check valve with an air space under or in the elastomeric seal. This makes it possible for the elastomeric seal to be inflated at the same time as there is an increase in the air pressure in the middle air space so that the seal is forced tightly against the edge of the flask. It keeps on moving towards it for a long enough distance, that is to say till the pattern and the foundry mold have been moved so far from each other that there is gap-like space filled with compressed air between them. On the supply of compressed air to the middle air space being turned off, the pressure in the said gap-like space goes down because some of the compressed air makes its way out through the porous mold and a further part of the air goes into the outer air space in the pattern plate support, the elastomeric seal does not at once go back into its resting position but only after some time or delay because the check valve is only opened at a pressure differential of over one bar or thereabouts so that air is then able to be let off into the middle space. It is in this way that the undesired effect noted earlier herein is put an end to.

An account will now be given of a working example of the invention using the diagrammatic figures herein.

DESCRIPTION OF A PREFERRED EMBODIMENT OF THE INVENTION

Figure 1:
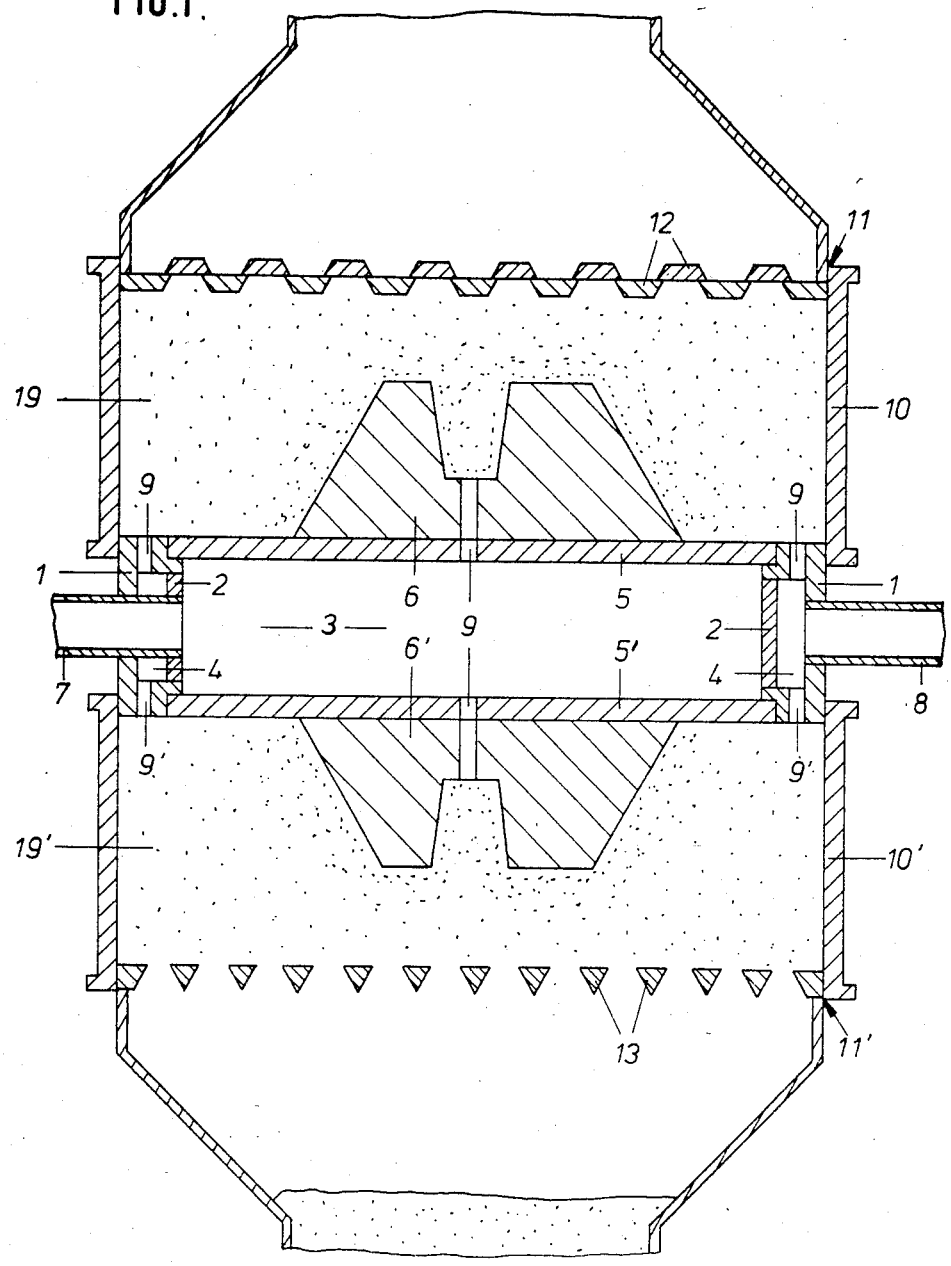
FIG. 1 is a view of the mold part, in the more limited sense of the wording, of a vacuum mold making machine made ready or designed for the molding of the molds of upper and lower flasks at the same time.

The mold part of the vacuum mold making machine working on the principle of vacuum shooting with mechanical compaction thereafter, is made up of a hollow pattern plate support 1, that for its part is separated off into a middle air space 3 or chamber and an outer space 4, placed round it, by upright parting walls 2. The upper and lower walls of the middle air space 3 are formed by an upper and lower pattern plate 5 and 5', that have the pattern halves 6 and 6' thereon. The air spaces 3 and 4 have ducts 7 and 8 so that by way of a valve circuit (not figured) they may be connected in common or separately with a vacuum or with an air supply so that it is then possible to put the spaces at different pressures. Each air space is connected by way of air openings 9, that are made sand-tight by filter nozzles thereon or by perforated foil fixed thereon, with the space inside of an upper and a lower flask 10 and 10', that may be adjusted vertically by way of a stripping cylinder (not shown). The flasks are made of such a size that their inner wall faces may be moved a limited distance along the upright walls of the pattern plate support 1, and of adjustable upper and lower shooting heads 11 and 11', that may be vertically adjusted as well. The shooting heads 11 and 11' have shooting grids, that may be shut after shooting has taken place and used as a pressing grid.

Figure 2:
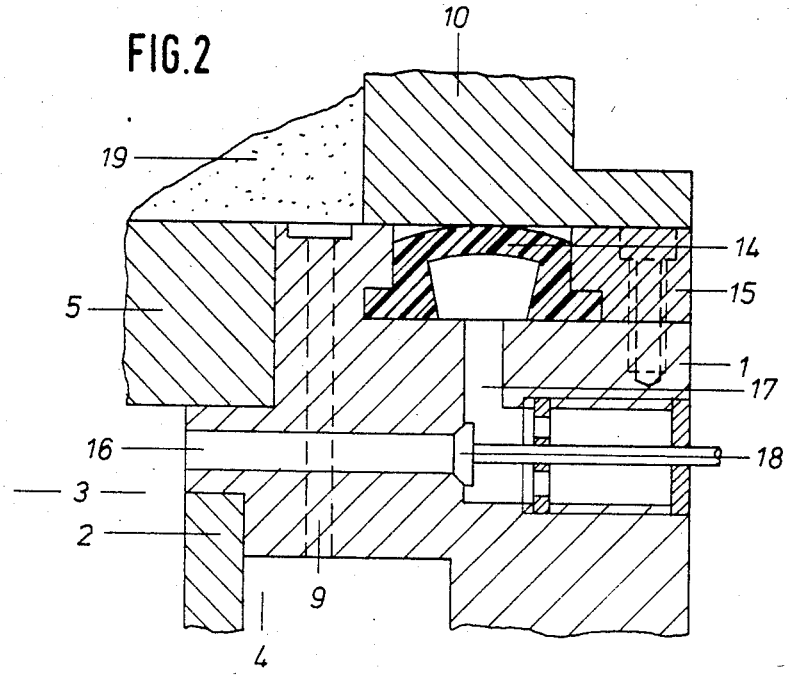
FIG. 2 is a detailed view of a pattern plate support with a flask thereon.
Figure 3:
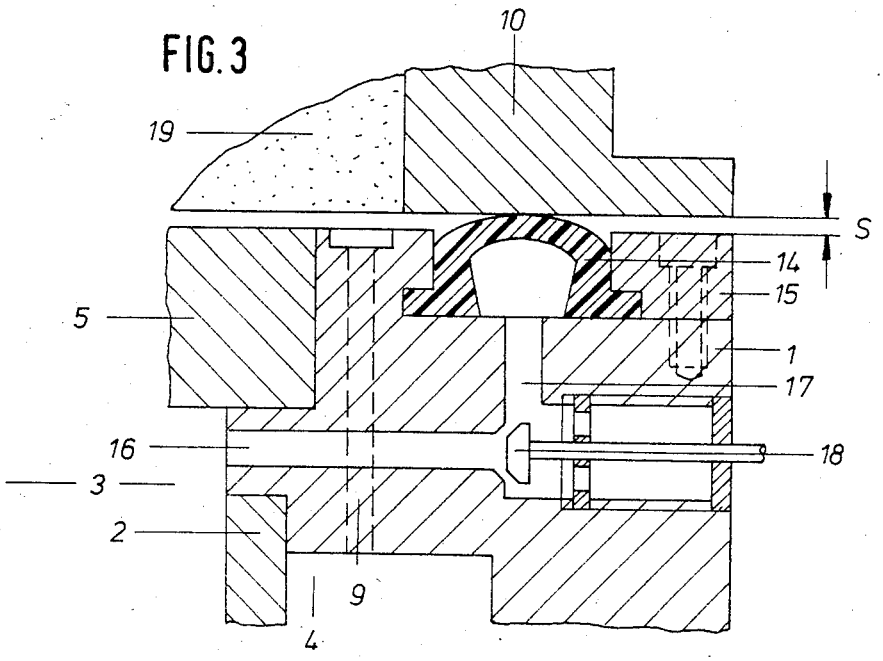
FIG. 3 is a detailed view like the view of FIG. 2 shortly after the start of the lifting operation.

Whereas in the working example of FIG. 1 the outer edge of the pattern plate support 1 is joined with the inner edge of the flask 10 and 10' so as to make a compressed air-tight joint, in the working example of FIGS. 2 and 3 there is an inflatable seal 14 positioned between the flask 10 and the pattern plate support 1. The seal 14 is in this respect seated in hollows or pockets in the pattern plate support 1, which in this case at the same time has the function of a flask support, the seal furthermore being kept in place by a keeper rail 15. It has a cross section like the Greek letter Ω and its inner space is joined up by way of air ducts 16 and 17 (with a differential pressure check valve 18 therein) with the middle air space.

For lifting the compacted mold 19 and 19' clear of the pattern means and lowering the patterns under the control of the valve circuit, compressed air is let into the middle air space 3 and into the outer air space 4 at the same time as the operation of the stripping cylinders for adjustment of the flasks 10 and 10'. The pressure of the air in the outer air space 4 may in this respect be adjusted to a lower level than the pressure in the middle air space 3. The let in air takes effect through the air openings 9, it acting against the face of the mold and helping in separating it, more specially in the case of molds with deep contours.

Once a gap-like space S has been formed between the mold and the outer face of the pattern, a sensor switch is triggered for turning off the supply of compressed air and the compressed air in the system is let off at a slow rate through the outer air space 4 and the air duct 8 by way of a choke valve that is not shown.

Up till this point in time there will have so far been no chance of the air being let off suddenly between the pattern plate support and the edge of the flask, because the breadth of the gap of the space S is in the working example to be seen in FIG. 1 smaller than the length of overlap between the pattern plate support and the flask. Later in the lifting operation the mold halves in this form of the invention are stripped up to the level of the edge of the flask at the mold parting plane. In the working example to be seen in FIGS. 2 and 3 the gap S is bridged over the inflatable seal 14, which is only let down again by way of the valve 18 when the air pressure in the middle air space 3 is at least one bar lower than in the space within the seal 14.

I claim:

1. A method of freeing a pattern or shaping element from a mass of foundry material, that has been compacted against said element, using gas pressure, said element and said material being within a gas-tight enclosure made up of at least two parts that are able to be moved in relation to each other with a sealed connection therebetween while keeping up said gas pressure, comprising the steps of:

forcing compressed gas into position between said element and said material so that the two are separated along an interface therebetween, further supplying said gas to said interface so that a gap is formed between the said element and the said foundry material, simultaneous with the step of further supplying said gas to said interface, moving the two parts of said enclosure away from each other to let said gap be formed, then shutting off gas supply to said enclosure, then unsealing said connection of said enclosure and moving said element clear of said compacted foundry material.

2. The method as claimed in claim 1 for moving a pattern out of a foundry mold, wherein compressed air is used for supporting detachment of the pattern from the foundry mold, said compressed air being passed through a pattern plate towards a surface of the mold, whereby an air-tight connection is produced between an edge of said pattern plate or a support thereof and a surrounding flask support or a flask placed thereon, forming the at least two parts making up the gas-tight enclosure, the air-tight connection being retained until the pattern has become completely detached from the surface of the mold and the supply of compressed air to a gap-like space formed between the pattern assembly and the mold is turned off before said air-tight connection is broken.

3. The method as claimed in claim 2 wherein said compressed air is let off from the gap-like space through said pattern plate and a corresponding hollow pattern plate support before the air-tight connection between the edge of the flask and the pattern plate is broken.

4. The method as claimed in claim 3 wherein the halves of the mold are thereafter stripped as far as the plane of the flask edge at the mold parting plane.

5. The method as claimed in claim 2 wherein said pattern is fixed to a plate in a compacting mold making machine.

6. The method as claimed in claim 5 wherein said machine is designed for mechanically compacting molds.

7. The method as claimed in claim 5 wherein said machine is designed for pneumatically compacting molds.

8. The method as claimed in claim 1 further comprising the step of:

letting off said gas from said enclosure, until the gas has been relaxed.

9. The method as claimed in claim 8 wherein said gas is let off through a small passage from said enclosure, so that a slow relaxation of the gas is achieved.

10. A mold and pattern assembly for clearing patterns from the molds using compressed air, comprising a pair of molds, at least one pattern plate, and a flask for use therewith, and means for maintaining a compressed, air-tight connection between the pattern plate and the flask during relative movement therebetween until a gap filled with compressed air has been formed between surfaces of the pattern plate and one of said molds.

11. The mold and pattern assembly as claimed in claim 10 comprising a hollow pattern plate support, pattern plates on two sides thereof and means for producing an air-tight connection between the said support and at least one flask.

12. The mold and pattern assembly as claimed in claim 11 comprising upright parting walls for division of a space within said pattern plate support into at least two air spaces, and means for putting said spaces under different air pressures.

13. The mold and pattern assembly as claimed in claim 10 wherein the flask is placed around the outer edge of the pattern plate or the pattern plate support for forming a sliding connection therewith that is compressed air-tight.

14. The mold and pattern assembly as claimed in claim 10 comprising a stripping means for moving the flask.

15. The mold and pattern assembly as claimed in claim 8 wherein said pattern plate support has a middle, first air space within it, said air space being connected by air openings in the pattern plate and with patterns within the mold space in the flask, there being a second air space placed around said first air space, second air space being connected with air openings outside the pattern plate edge.

16. The mold and pattern assembly as claimed in claim 8 comprising an elastic gasket between the pattern plate and the flask.

17. The mold and pattern assembly as claimed in claim 16 wherein said gasket is designed to be acted upon on one side by compressed air and to be inflated by such air.

* * * * *